US006763639B2

(12) United States Patent
Bennett et al.

(10) Patent No.: US 6,763,639 B2
(45) Date of Patent: Jul. 20, 2004

(54) THRESHOLD ASSEMBLY WITH PRE-FITTED DRAINING JAMB BOOTS AND PRE-FITTED MULL BOOTS

(75) Inventors: Joel S. Bennett, Greensboro, NC (US); Victor T. Massey, Greensboro, NC (US)

(73) Assignee: Endura Products, Inc.

( * ) Notice: Subject to any disclaimer, the term of this patent is extended or adjusted under 35 U.S.C. 154(b) by 202 days.

(21) Appl. No.: 09/902,042

(22) Filed: Jul. 10, 2001

(65) Prior Publication Data

US 2002/0112421 A1 Aug. 22, 2002

(Under 37 CFR 1.47)

Related U.S. Application Data

(60) Provisional application No. 60/217,174, filed on Jul. 10, 2000.

(51) Int. Cl.[7] ..... E06B 1/04

(52) U.S. Cl. ..... 52/212; 52/204.54; 52/717.01; 49/467; 49/471; 49/476.1; 49/483.1; 49/489.1; 49/490.1; 49/504; 160/92

(58) Field of Search ..... 52/204.1, 204.5, 52/211, 210, 212, 208, 716.2, 717.01, 717.04, 204.7, 204.66, 204.4; 49/476.1, 483.1, 489.1, 490.1, 504, 505, DIG. 2, 467, 463, 469–471, 142, 143; 160/92

(56) References Cited

U.S. PATENT DOCUMENTS

| | | | | |
|---|---|---|---|---|
| 258,486 | A | | 5/1882 | Singer |
| 719,672 | A | | 2/1903 | Jewell et al. |
| 1,231,916 | A | | 7/1917 | Landry |
| 2,875,481 | A | | 3/1959 | Erkkila |
| 3,032,839 | A | | 5/1962 | Miller |
| 5,136,814 | A | | 8/1992 | Headrick |
| 5,426,894 | A | | 6/1995 | Headrick |
| 5,524,391 | A | | 6/1996 | Joffe et al. |
| 5,687,508 | A | * | 11/1997 | Fitzhenry, Jr. et al. ..... 49/471 |
| 6,125,599 | A | | 10/2000 | Mees et al. |
| 6,371,188 | B1 | * | 4/2002 | Baczuk et al. ..... 160/92 |
| 6,378,266 | B1 | * | 4/2002 | Ellingson ..... 52/656.4 |
| 6,484,446 | B2 | * | 11/2002 | Young ..... 49/469 |
| 6,637,158 | B2 | * | 10/2003 | Bennett ..... 49/504 |
| 2002/0078641 | A1 | * | 6/2002 | Procton et al. ..... 52/204.1 |
| 2002/0194788 | A1 | * | 12/2002 | Bennett ..... 49/467 |
| 2003/0005644 | A1 | * | 1/2003 | Reithmeyer et al. ..... 49/467 |
| 2003/0106269 | A1 | * | 6/2003 | Bauman et al. ..... 49/467 |

FOREIGN PATENT DOCUMENTS

| | | |
|---|---|---|
| FR | 2575-215 A | 6/1986 |

* cited by examiner

*Primary Examiner*—Carl D. Friedman
*Assistant Examiner*—Yvonne M. Horton
(74) *Attorney, Agent, or Firm*—Womble Carlyle Sandridge & Rice, PLLC

(57) ABSTRACT

An entryway system includes an elongated threshold assembly and a pair of plastic jamb boots attached to the ends of the threshold assembly. The jamb boots have flat level upper faces and a pair of jambs having square-cut bottoms are secured to the jamb boots and extend upwardly from the threshold assembly. A head jamb completes a door frame. The jamb boots may be formed with integral drains that receive water from within the threshold cap channel of the threshold assembly and direct it away from the entryway. The plastic jamb boots prevent rotting and eliminate the need to mill the bottoms of jambs with haunches configured to fit the threshold assembly. Plastic mull post boots also are provided for supporting square-cut bottom mull posts in sidelight or double door entryways.

10 Claims, 7 Drawing Sheets

THRESHOLD ASSEMBLY WITH PRE-FITTED DRAINING JAMB BOOTS AND PRE-FITTED MULL BOOTS

REFERENCE TO RELATED APPLICATION

The benefit of the filing date of U.S. provisional patent application serial No. 60/217,174 filed on Jul. 10, 2000 is hereby claimed.

TECHNICAL FIELD

This invention relates generally to entryway systems for homes and commercial buildings an more specifically to door frame assemblies incorporating continuous thresholds to which vertically extending jambs and perhaps mull posts are attached.

BACKGROUND

Entryway systems used in building construction generally include a pair of vertically extending door jambs and a head jamb that frame the entryway and receive a hinged door. An elongated threshold assembly is attached at its ends to the bottoms of the door jambs and spans the bottom of the entryway. Many modern threshold assemblies include an extruded aluminum frame having an upwardly open channel from which a sill slopes outwardly and downwardly. A threshold cap, which may be made of plastic or wood, is disposed in the upwardly open channel and underlies a closed door mounted of the entryway. The threshold cap usually is vertically adjustable within its channel to engage and form a seal with a flexible sweep attached to the bottom of the door.

Some entryways include sidelights that flank the door on one or both sides thereof. In such sidelight entryways, mullions or mull posts rest on and extend vertically from the top of the threshold assembly to the head jamb of the entryway. The mull posts along with the jambs and head jamb define the door opening or openings and the sidelight openings of the entryway. Many variations of this basic theme such as, for example, patio door entryways, inswing entryways, and outswing entryways are available to accommodate an equal number of variations of entryway designs.

Traditionally, the bottoms of door jambs, which usually are made of wood, are matted and attached to the ends of the threshold assembly by milling a specially shaped angled jamb haunch or tenon in the bottoms of the jambs and fitting and stapling or screwing the bottoms of the jambs to the assembly. A portion of the haunch overlaps and sits atop the sloped sill of the threshold assembly. The problems with this traditional construction technique are many. For instance, since virtually every brand and style of threshold assembly has a different cross-sectional profile, the jamb haunches in each case must be precisely and specially milled to fit the profile of the particular threshold assembly to which they are to be attached. This means that pre-hangers must own and operate expensive and accurate milling machinery and must maintain a number of different shaped milling cutters to accommodate the various configurations of threshold assemblies. This is also true for the bottoms of mull posts, which must be provided with an angled bottom cut specially shaped to rest atop the sloped sill of the threshold assembly.

Another problem with traditional entryway construction techniques relates to the fact that the end grain of the wooden jambs and mull posts rests directly on the sub-floor and/or sill deck. Thus, moisture from rainwater and the like that may seep or form beneath the ends of the jambs and mull posts wicks into the wood of these components causing rot and decay. A further problem is that water that may seep under the threshold cap of the assembly and into the upwardly open channel in which it resides tends to migrate to and puddle at the ends of the channel against the bottom portions of the wooden jambs. There it gradually soaks into the wood of the jambs, also causing eventual rot and deterioration.

Thus, a need exists for an improved entryway system that addresses and solves the problems and shortcomings of the prior art. Such an entryway system should eliminate the need for specially milled jambs and mull posts in order to fit these elements to the wide variety of available threshold assembly profiles, should eliminate the rotting and deterioration that typically occurs at the bottoms of jambs and mull posts where they meet the threshold assembly, and should provide for the efficient draining away of water that may seep beneath the threshold cap of the threshold assembly or otherwise form or collect in the upwardly open channel of the threshold. In addition, the system should provide for standardization of jamb and mull post lengths and should accommodate jambs and mull posts with simple square cut bottom ends. Finally, the system should provide for simple, efficient, and accurate assembly by a pre-hanger and should present an aesthetically pleasing appearance that is appealing to a homeowner. It is to the provision of such an entryway system that the present invention is primarily directed.

SUMMARY OF THE INVENTION

Briefly described, the present invention, in one preferred embodiment thereof, comprises an improved entryway system that eliminates the problems with traditional prior art entryways and entryway construction techniques. The entryway system comprises an elongated continuous threshold assembly that preferably is made of extruded aluminum formed with an upwardly open channel from which a downwardly and outwardly sloping sill extends. A vertically adjustable threshold cap is disposed in at least a portion of the channel for underlying a closed door of the entryway.

A jamb boot is attached to each end of the threshold assembly for receiving and mating with the bottom of a respective one of the vertically extending door jambs of the entryway. Each jamb boot preferably is made of injection molded plastic and is pre-formed with an angled tenon or haunch that is configured precisely to fit and rest on the sill deck of the particular threshold assembly to which the jamb boot is attached. In this regard, the jamb boot resembles the milled bottom end of a traditional wooden jamb. Each jamb boot preferably is shaped with a cross-sectional profile that corresponds essentially to the cross-sectional profile of a door jamb and attached brick mold. However, the jamb boots may be formed with a profile that does not include a brick mold portion if desired. Each jamb boot extends upwardly a short distance from the end of the end of the threshold assembly and terminates in an upper face or surface. The upper surfaces of the jamb boots are substantially flat (although calking grooves or other features may be formed in the upper surfaces if desired) and are formed to lie in a horizontal plane or planes with the threshold assembly resting on a level surface.

The jamb boots of this invention are pre-attached and sealed with silicone sealant or other appropriate adhesive to the ends of the threshold assembly by a threshold assembly manufacturer before shipping the threshold assembly to a pre-hanger for incorporation into a completed entryway system. At the pre-hanger's facilities, wooden jambs are prepared for attachment to the threshold assembly simply by square cutting the bottoms of the jambs. The square-cut jamb bottoms are then mated to the substantially flat top surface of the corresponding jamb boots, and attached to the boots preferably with screws extending through the bottom of the jamb boots and into the ends of the jambs. In one embodiment, strategically positioned alignment nibs and a step are formed in the upper surface of the jamb boots to align the bottoms of the jambs precisely with their jamb boots before the jambs are attached. In this way, proper alignment is essentially automatic and a pre-hanger may assemble an entryway quickly and efficiently without special jigs and on a simple horizontal assembly table.

In one embodiment, each of the jamb boots is formed with an internal drain channel that receives collected water from the ends of the upwardly open channel of the sill and directs the water to the outside face of the jamb boot, where the water drains away from the entryway. Thus, water that may seep or form beneath the threshold cap is harmlessly drained away and does not collect beneath the threshold cap. The jamb boots also may be formed without this draining feature if desired.

The entryway system of the invention also includes injection molded plastic mull post boots for use with sidelight or other types of entryways where mull posts are employed. The mull post boots also are pre-formed with an angled bottom surface that precisely matches the angle of and sits atop the sill deck and each mull post boot has a substantially flat level top surface. As with the attachment of jambs, wooden mull posts are attached to the threshold assembly by square cutting their bottoms, mating the bottoms of the mull posts with the flat level tops of the mull post boots, and attaching the mull posts with screws that extend through the mull post boots from below and into the bottoms of the mull posts. A traditional head jamb or header is attached with staples or screws to the tops of the jambs and mull posts to complete the frame of the entryway. A door or doors may be hung in the frame and, where applicable, sidelights may be mounted in the frame in the traditional way to complete the pre-hanging process and the entryway. The completed entryway may then be shipped to a construction site for installation.

In one embodiment for use with traditional milled-bottom jambs, the jamb boots do not extend upwardly from the ends of their threshold assembly. Instead, a thin plastic plate, which preferably is shaped to match the profile of the jamb and perhaps an attached brick mold, extends outwardly from the ends of the threshold and rests on a sub-floor when the threshold assembly is installed. In this embodiment, the bottom end of a traditional wooden jamb rests atop the plastic plate and not directly on the sub-floor to prevent moisture wicking into the end grain. Preferably, the upper surface of the plate is formed to define a shallow reservoir beneath the end of the jamb and a weep hole is provided at the forward edge of the plate. In this way, water that does collect beneath the end of a jamb does not engage the jamb bottom but, instead, resides in the shallow reservoir until it can drain out through the weep hole. Thus, rotting of jamb bottoms due to water wicking is substantially eliminated.

It thus will be seen that a unique entryway system is now provided that, in one embodiment, eliminates the requirement to mill the bottoms of door jambs and mull posts with specially configured haunches and angled ends to match the particular threshold assembly being used in the entryway. Accordingly, pre-hangers need not maintain and operate expensive end-milling machinery to mill the bottoms of jambs and mull posts. Further, the jamb and mull post boots of the invention are sized and configured such that standard length square-cut jambs and mull posts may be used with an entire line of threshold assemblies for various types of entryway systems. Thus, the need to stock different length jambs and mull posts for use with different threshold assemblies is eliminated. Since the jamb and mull post boots are formed of plastic, water that may collect or seep beneath them never reaches the wood of the attached jambs and mull posts. Accordingly, rotting and deterioration common with traditional entryway systems is eliminated. Finally, the draining feature in one embodiment of the jamb boots ensures that water does not collect in the channel beneath the threshold cap of the assembly. These and other features, objects, and advantages of the entryway system of this invention will become more apparent upon review of the detailed description set for below when taken in conjunction with the accompanying drawing figures, which are briefly described as follows.

DETAILED DESCRIPTION OF THE PREFERRED EMBODIMENTS

Figure 1:
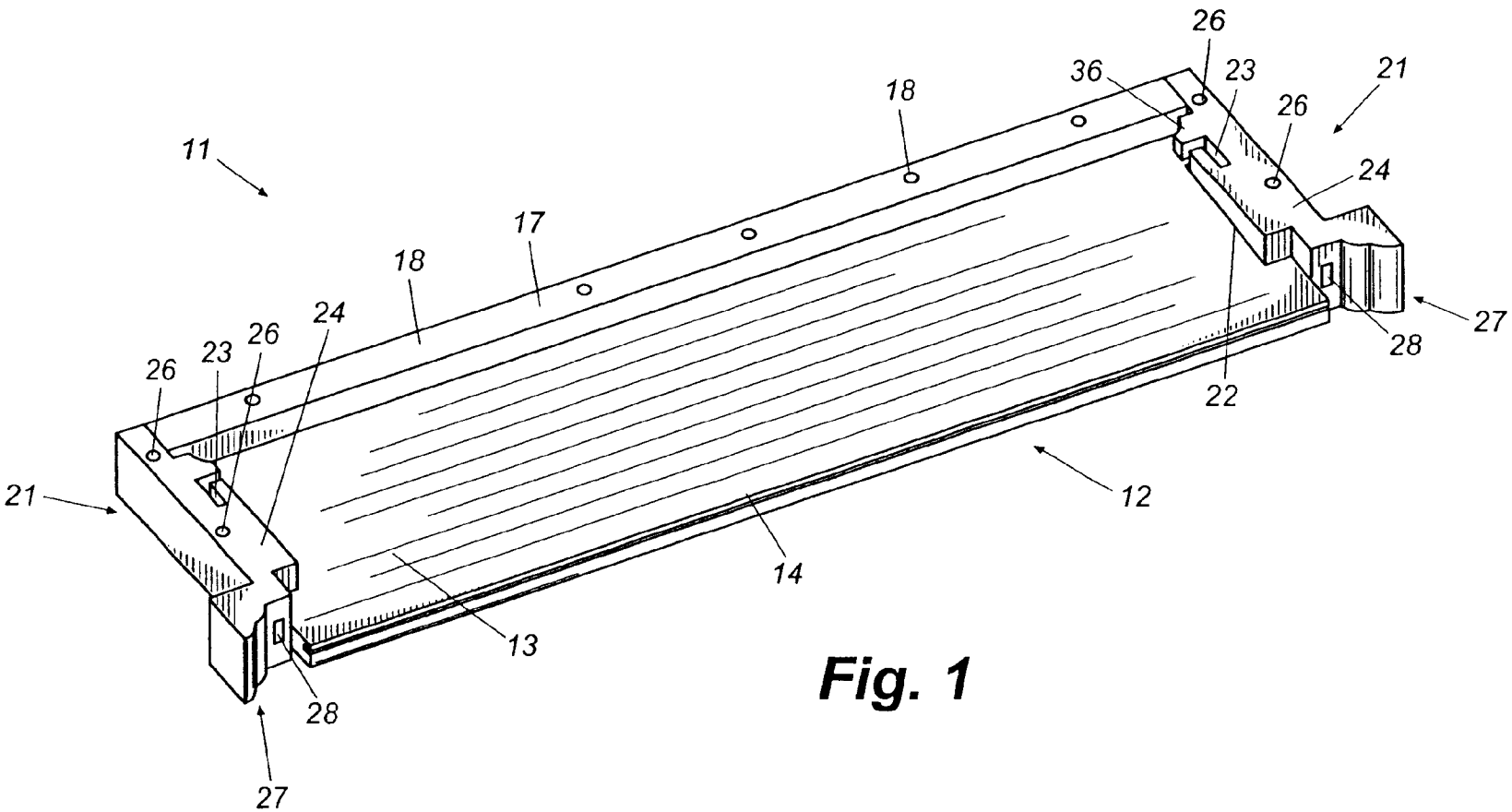
FIG. 1 is a perspective view of a threshold assembly with attached jamb boots that embodies principles of the present invention in one preferred form.

Referring now in more detail to the drawings, in which like numerals refer to like parts throughout the several views, FIG. 1 illustrates one preferred embodiment of a threshold assembly for use in an entryway system according to the invention. The threshold assembly 11 comprises an extruded aluminum frame 12 formed to define an upwardly open channel 16 (FIG. 4) from which a sill 13 slopes downwardly and outwardly to a forward edge 14. A threshold cap 17 is disposed in the channel 16 for underlying a closed door of the entryway system and includes an array of adjustment screw access ports 18 for adjusting the vertical position of the threshold cap within the channel. The ends 19 (FIG. 2) of the frame are cut square.

A jamb boot 21 is attached to each end 19 of the elongated frame 12 and each jamb boot preferably is injection molded from an appropriate plastic or composite material to resist rot and decay caused by moisture. Each jamb boot 21 is formed with a jamb haunch 22 that is sized and configured to overlap and sit atop the end portion of the sill deck just as does the milled haunch on the bottom end of a traditional wood jamb. If desired, a weather strip slot 23 may be formed in the jamb boot for receiving the bottom end of a length of weather strip as described in more detail below. However, the weather strip slot may not be desired and, in fact, is not included in some embodiments of the invention. In the embodiment of FIG. 1, which includes a weather strip slot 23, a weather strip stiffener 36 is formed in the jamb boot 21 for stiffening the weather strip at the critical bottom corner of the entryway to inhibit migration of moisture through the entryway when the door is shut.

The jamb boot 21 in FIG. 1 is formed with a substantially flat, level top face 24 and with a forward edge portion 27 that is shaped to match the contours of a traditional brick mold. Details such as, for example, caulking grooves, may be formed in the top face 24 of the jamb boots, as illustrated and discussed with respect to the embodiment of FIGS. 6 through 8 below. A pair of screw holes 26 are formed through the jamb boot for securing the boot to the bottom of a wooden jamb. The jamb boot is formed with an internal drain channel (not visible in FIG. 1) that terminates at the forward edge of the boot in a drain port 28.

Figure 2:
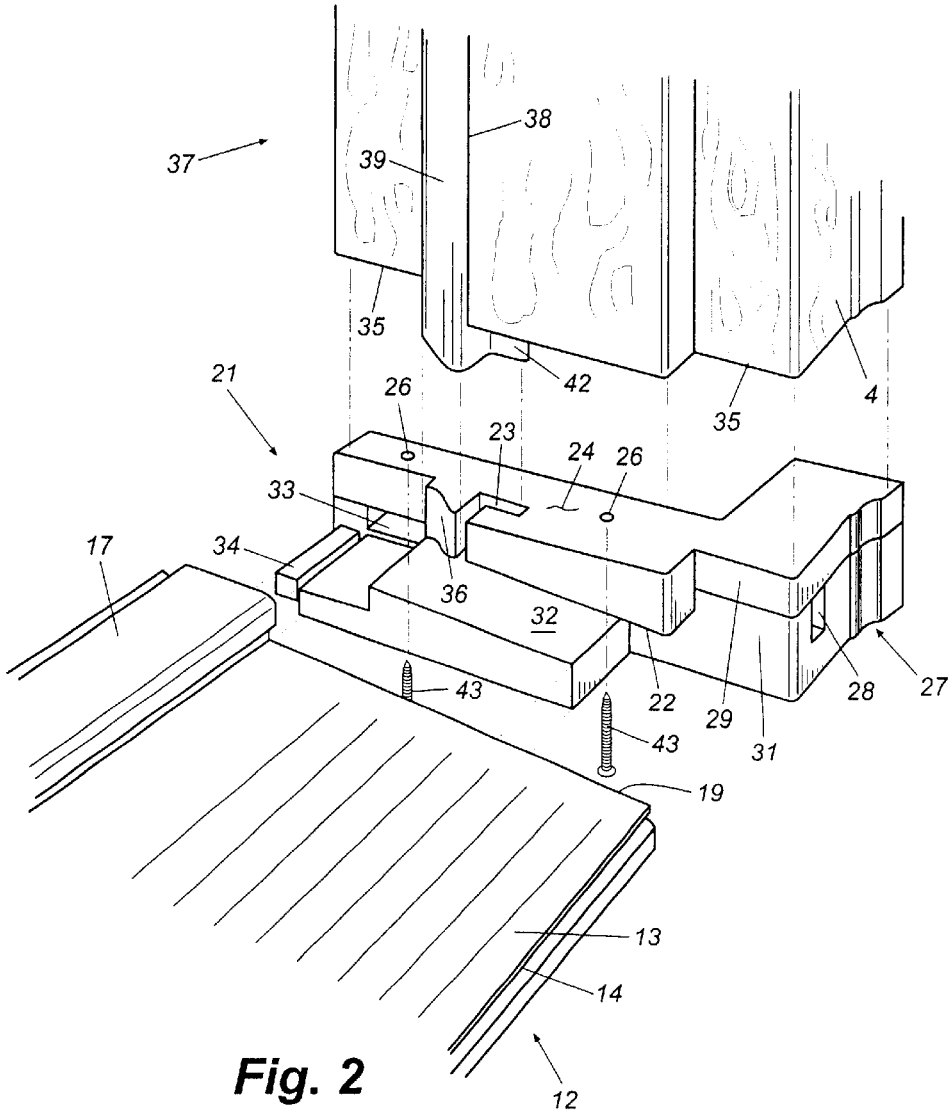
FIG. 2 is a perspective exploded view of one end of the threshold assembly of FIG. 1 showing the configuration of the jamb boot in more detail and illustrating the attachment of the boot to the threshold assembly and the attachment of the jamb to the boot.

Referring to FIG. 2, the end portion of the threshold frame 12 is illustrated with its sill 13 terminating in forward edge 14 and with a square cut end 19. The threshold cap 17 resides in the upwardly open channel 16 (FIG. 4) of the frame and is vertically adjustable as described above. Jamb boot 21 is illustrated in more detail in FIG. 2 and is seen to be formed from an upper section 29 and a lower section 31 appropriately aligned and secured together. The lower section 31 is formed with a support and attachment block 32, which is sized and configured to be received within a corresponding channel (not visible) extruded on the bottom portion of the frame 12 and secured thereto with adhesive, staples, or other appropriate fasteners. In fact, the support and attachment block may take the place of the wooden or composite reinforcement block or substrate that traditionally is installed and fastened beneath the ends of the threshold frame. A filler block 34 also may be provided, depending upon the profile of the frame, to be received in and fill appropriate voids in the end portion of the frame. As detailed below, the lower portion 31 of the jamb boot is formed with an internal drain channel that terminates in a drain port 28 at the forward edge of the boot and that originates with a drain mouth 33 at the rear portion of the lower section 31.

The upper portion 29 of the jamb boot is secured atop the lower portion with appropriate adhesive or other fastening means and is formed with a haunch 22 having an angled bottom surface that overlaps and sits atop the deck of the sill 13 when the jamb boot is secured to the frame. This mimics the configuration of the traditional milled tenon or haunch on the bottom of a wooden jamb. The upper portion 29 in this embodiment is further formed with a weather strip slot 23 and an associated weather strip stiffener 36, the function of which is described in more detail below. Screw holes 26 extend through the jamb boot from the bottom surface to the top surface thereof for receiving screws 43 used to secure the jamb boot to the bottom of a wooden jamb.

A traditional wooden jamb 37 has a square-cut bottom end 35 and is aligned with and secured atop the flat, level upper face 24 of the jamb boot 21. The exterior profile of the jamb boot 21 is configured to match the exterior profile of the jamb 37 such that when the jamb is attached to the jamb boot, the jamb boot visually becomes a short downward extension of the jamb. Preferably, the jamb is secured to the jamb boot by means of screws 43 that extend through the jamb boot from the bottom thereof and into the bottom end of the jamb.

A length of weather strip 39 is attached in the traditional way to the jamb extending along the stop 38 thereof for engaging and sealing against a closed door of the entryway. In the embodiment of FIG. 2, the weather strip projects downwardly a short distance from the bottom of the jamb and a portion of this projection 42 is received in the weather strip slot 23 formed in the jamb boot 21. The weather strip stiffener 36 then resides in the fold of the projection 42 of the weather strip to stiffen the weather strip in this region. The result of this stiffening is that the weather strip bears firmly against the bottom corner of a closed door and the front of the threshold cap 17 to prevent leakage of water at this location, where leakage has heretofore been a significant problem. It should be noted that in the embodiment of FIGS. 6 though 8, discussed in more detail below, no weather strip slot is provided and the bottom end of a length of weather strip does not extend to the sill deck but instead terminates at the top face of the jamb boot. Such a configuration also inhibits leakage by eliminating the wicking of water from the sill deck up the weather strip and into a dwelling.

With the jamb boots secured to the ends of the threshold assembly and the jambs secured to the jamb boots, the resulting entryway frame can be hung with a door and installed in the usual way in a building. Since the jamb boots of the entryway, which are made of plastic, are the only portions of the jamb that contact the threshold assembly and the subfloor, rotting and deterioration due to moisture, insects, and the like is eliminated as are problems caused by wicking of moisture into the naked bottom ends of wooden jambs. In addition, the weather strip stiffener 36 in the embodiment of FIGS. 1 and 2 can provide enhanced sealing at the lower corner of a closed door where leakage is a problem and water that may seep into the channel beneath the threshold cap is drained away from the assembly and out the drain port 28.

Figure 3:
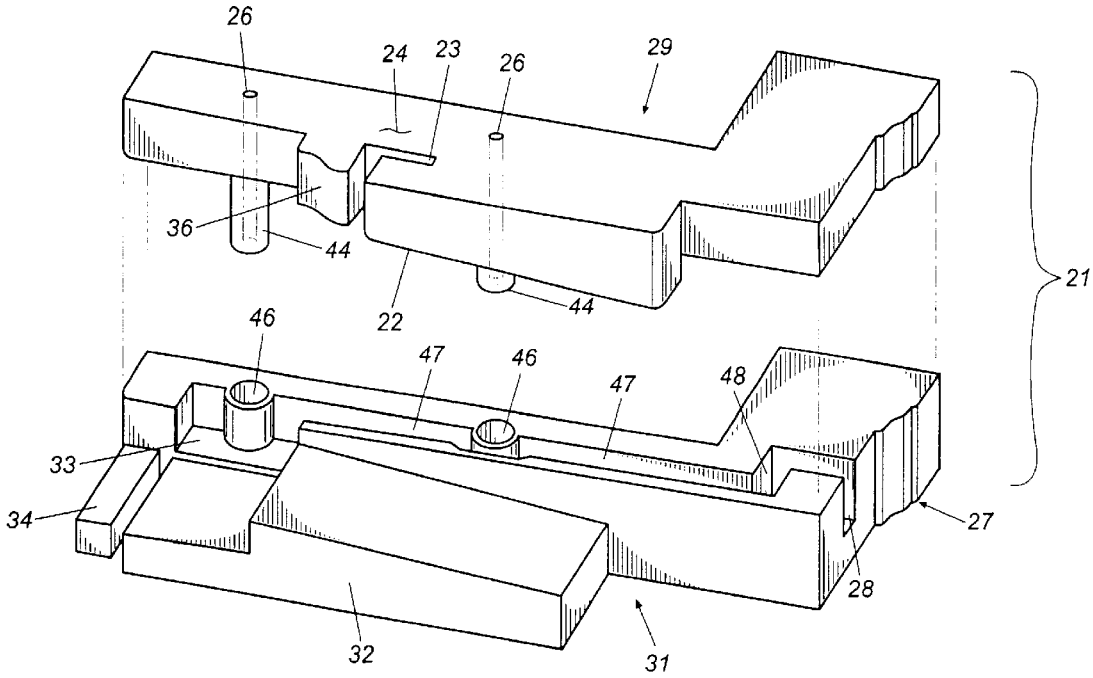
FIG. 3 is an exploded perspective view of the jamb boot illustrated in FIGS. 1 and 2 illustrating an internal drain channel formed therein for draining water out of the upwardly open channel of the threshold assembly.

FIG. 3 is an exploded perspective view of the jamb boot 21 showing the upper section 29 exploded away from the lower section 31 to reveal the structure of the drain built into the boot. A drain channel 47 is formed in the lower section 31 of the boot and extends generally from a mouth 33, through the lower section of the boot, to a drain port 28 on the front of the boot. An offset 48 is formed in the channel 47 adjacent the port 28. The purpose of the offset is to provide a primary barrier against water from windblown rain and the like being blown backwards through the drain channel 47 and into the threshold cap channel of the threshold assembly. A secondary vertical barrier 51 (FIG. 4) is also provided to enhance resistance to this phenomenon. Further, a baffle or baffles also may be formed in the channel at strategic locations if desired as additional features to inhibit windblown rainwater from traveling up the drain channel.

In FIG. 3, the upper section 29 of the jamb boot is seen to be formed with a pair of alignment posts 44 that depend therefrom. The lower section is formed with a corresponding pair of alignment holes 46 sized to receive the alignment posts 44 for aligning the upper and lower sections of the jamb boot as they are secured together. Preferably, the screw holes 26 extend through the alignment posts for receiving the attachment screws. While this particular arrangement is preferred, a variety of different configurations of alignment posts and screw holes are possible, all within the scope of the invention.

Figure 4:
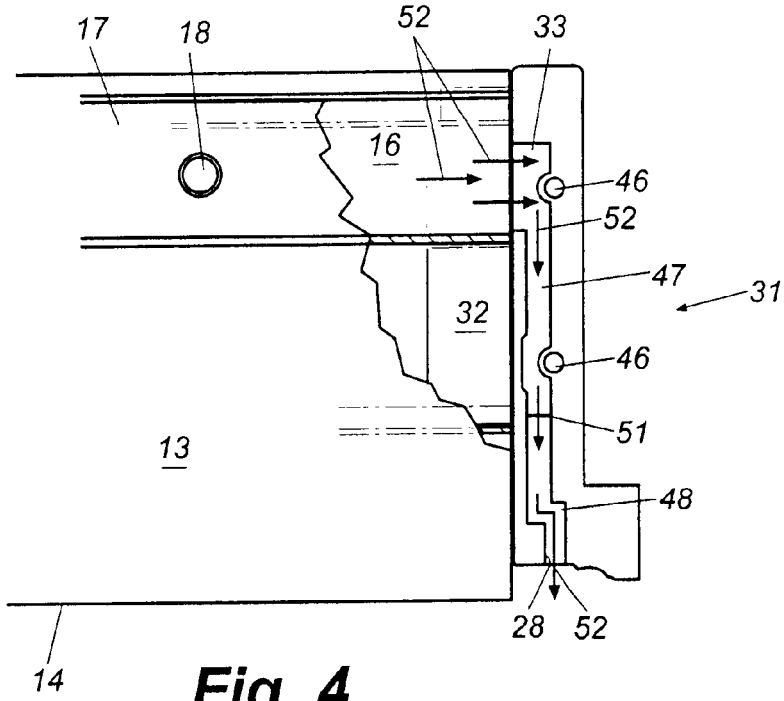
FIG. 4 is a top plan partially cut-away view of an end of the threshold assembly of FIG. 1 illustrating attachment of the boot and the draining of water from beneath the threshold cap.

FIG. 4 illustrates the draining feature of the jamb boot of the present invention. Only the lower section 31 of the jamb boot is shown in FIG. 4 for clarity of description and a portion of the threshold frame and threshold cap are cut away to show internal structures thereof. The frame of the threshold assembly is formed with an upwardly open channel 16 that receives the threshold cap 17. A sill 13 slopes outwardly and downwardly from the channel 16 to a forward edge 14. The support and attachment block 32 of the jamb boot extends into a corresponding channel formed in the bottom of the extruded frame and is secured with staples or other appropriate fasteners or adhesives. When so attached, the floor of the channel 16 meets the mouth 33 of the drain channel 47 and, in practice, a bead of sealant may be applied at the junction of the two during assembly to prevent leakage.

In the event that water should seep into the channel or simply form there as a result of condensation in certain weather conditions, the water, indicated at 52, flows to the ends of the channel 16, enters the drain channel 47 at the mouth 33 thereof, and is directed by the drain channel 47 to the port 28, where the water is expelled and drains away from the entryway. The vertical barrier or step 51 formed in the floor of the drain channel, in conjunction with the barrier 48, insures that while water may flow freely down the channel and away from the entryway, it cannot be blown by wind in a storm or the like back up the drain channel and into the threshold cap channel. Thus, any water that becomes trapped in the threshold cap channel drains easily therefrom through the drain channel.

The general principle of the jamb boot described above applies also to mull boots at the bottoms of mull posts of sidelight or double door entryways. Such a mull boot preferably is formed of injection molded plastic material and has a bottom face that is angled to sit on the sill deck of the extruded aluminum frame. As with the jamb boots, the mull boots are formed with a substantially flat level upper surface or face for attaching a square-cut bottom end of a mull post with screws. Rot and decay is avoided and specially milled mull posts with custom angled bottom ends, as have been required in the past, do not have to be manufactured.

Figure 5:
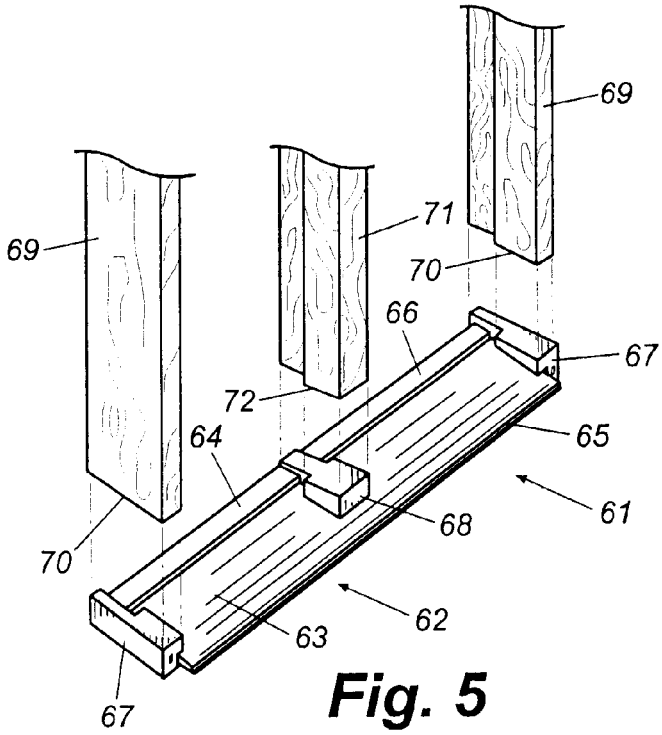
FIG. 5 is a perspective view illustrating the present invention incorporated into a sidelight entryway system and showing jamb boots, a mull boot, and the alignment of square-cut jambs and mull posts with their respective boots for attachment.

FIG. 5 illustrates a sidelight entryway with mull post that embodies principles of the invention. The entryway comprises a threshold assembly 61 having an extruded aluminum frame 62 formed with an upwardly open channel (not visible) from which a sill extends outwardly and slopes downwardly to a forward edge 65. The particular type of entryway illustrated in FIG. 5 is a sidelight entryway, for supporting a door flanked by a sidelight panel. Accordingly, in the traditional manner, a threshold cap 64 is disposed in a portion of the channel for underlying the closed door of the entryway and a sidelight cap 66 is disposed in the portion of the channel that underlies the sidelight panel. According to the invention, plastic jamb boots 67 are attached to the ends of the threshold assembly frame and have substantially flat level upper surfaces. Also according to the invention, a plastic mull post boot 68 rests on and is attached to the frame between the threshold cap and the sidelight panel cap and is formed with a substantially flat level upper surface. Wooden side jambs 69 having square cut bottom ends 70 are mated with and attached to the jamb boots 67 as described above to extend upwardly from the threshold assembly. Similarly, a wooden mull post 71 having a square cut bottom end 72 is mated with and attached to the mull post boot 68 and extends upwardly therefrom. Accordingly, in the entryway configuration of FIG. 5, the jambs and mull post define the door opening and the sidelight panel opening respectively of the entryway. The top ends of the jambs and mull post are attached to a head jamb or header (not shown) in the traditional way to complete the entryway frame. A door and a sidelight may then be mounted in their respective openings to complete the assembly.

It will be appreciated by those of skill in the art that while a sidelight entryway is shown in FIG. 5 as an exemplary illustration, the present invention is applicable to virtually any type of modern entryway. Such entryways include, for example, inswing entryways, outswing entryways, patio door entryways, sidelight panel entryways, handicapped accessible entryways, and others. The invention is applicable to these and virtually any type of entryway system where wooden frame components traditionally have mated directly with a threshold assembly. Accordingly, the invention shall not be considered to be limited to any particular type or style of entryway, even though a particular style may be illustrated in the drawing figures.

Figure 6:
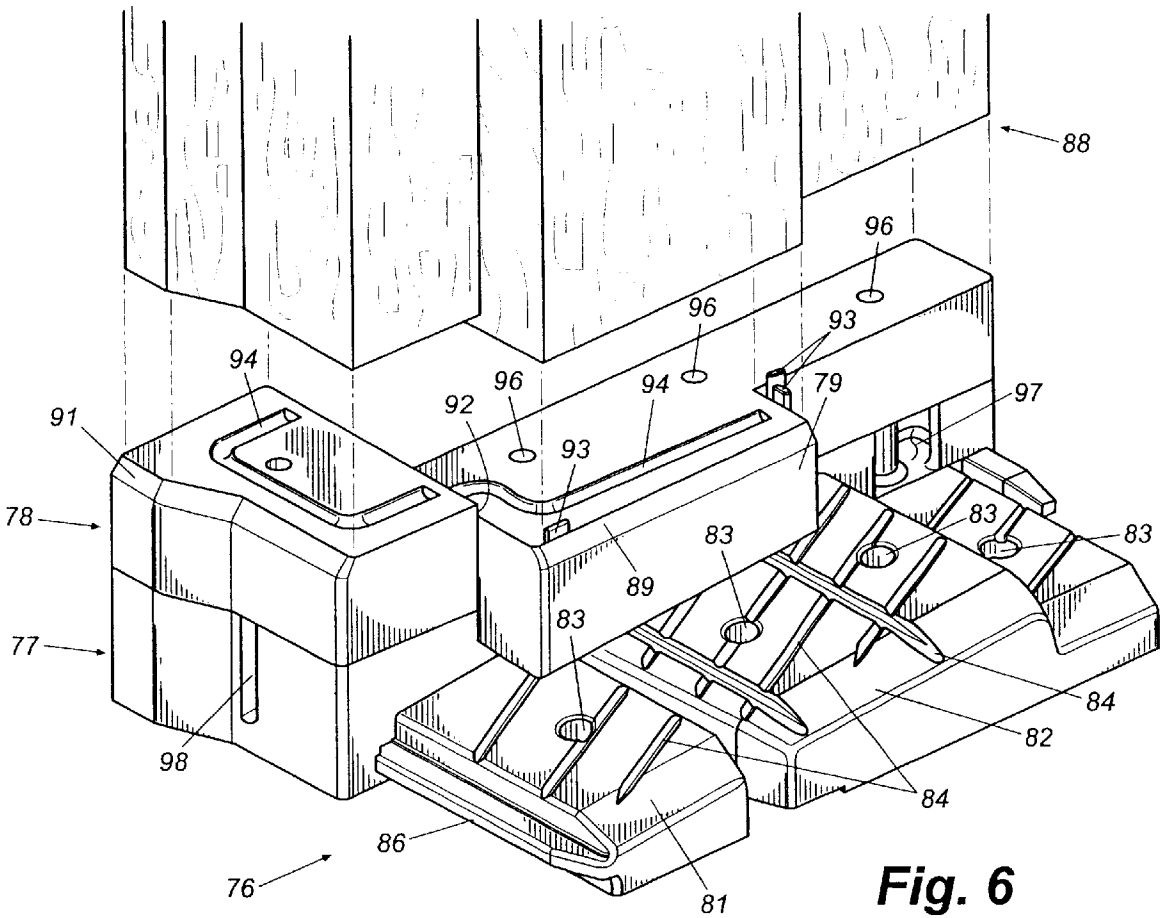
FIG. 6 is a perspective partially exploded view of another embodiment of a jamb boot according to the invention and illustrating jamb alignment features and a calking groove formed in the jamb boot.
Figure 7:
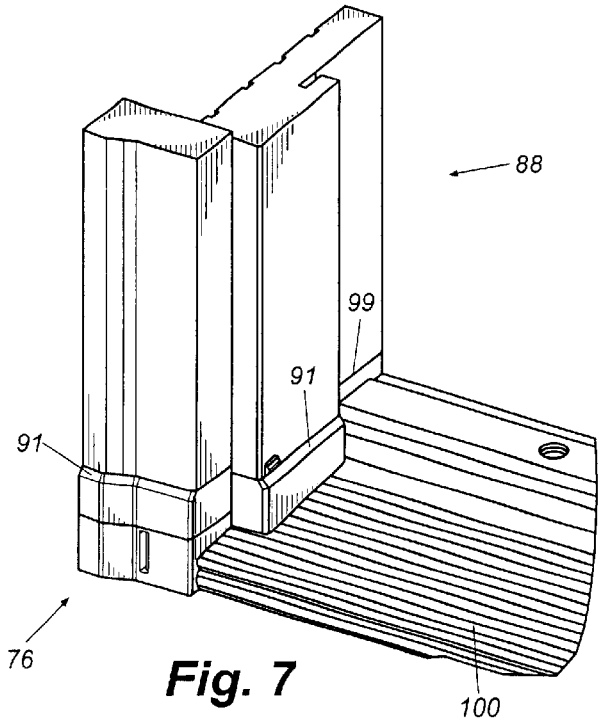
FIG. 7 is a perspective view of the jamb boot of FIG. 6 shown attached to an end of a threshold and supporting a vertically extending door jamb.

FIGS. 6 and 7 illustrate another preferred embodiment of a jamb boot for use with an entryway of the present invention. This embodiment is similar in many respects to the embodiment of FIGS. 1 through 3, but includes certain refinements and enhancements over the previous embodiment. Referring to FIG. 6, the jamb boot 76, which preferably is formed of plastic, has a lower section 77 and an upper section 78 secured together with appropriate adhesives. The lower section 77 is formed with projecting attachment and support blocks 81 and 82, which are sized to slide into corresponding channels extruded in the aluminum frame 100 (FIG. 7) of a threshold assembly for attaching the jamb boot to the end of the frame. The attachment and support blocks 81 and 82 are formed with adhesive injection ports 83, which extend through to the bottoms of the blocks. The upper surfaces of the attachment and support blocks 81 and 82 are formed with grooves or channels 84, some of which extend at an angle with respect to their respective blocks. Friction lock ribs 86 are formed along at least some of the edges of the attachment and support blocks 81 and 82.

The just described configuration and features of the attachment and support blocks 81 and 82 facilitate the efficient and effective attachment of the jamb boot 76 to the end of an aluminum threshold frame during assembly of a threshold. More specifically, during assembly, the jamb boot is pressed into the end of the frame with its attachment and support blocks sliding into channels extruded in the bottom of the frame. As the blocks slide into their channels, the small friction lock tabs 86, which are sized to project slightly beyond the sides of the channels, are scraped partially away by the ends of the channel walls. This insures that the remaining portions of the friction lock tabs 86 tightly engage the channel walls, thereby forming a friction fit that holds the jamb boot firmly in place on the end of the threshold frame.

With the jamb boot pressed and held on the frame, an appropriate sealant and adhesive, such as, for example, a silicone sealant, is injected through the adhesive injection ports 83 from the bottom of the attachment and support blocks 81 and 82. The sealant flows through the ports 83 and begins to spread out and fill the small space between the top surfaces of the attachment and support blocks and the bottom surface of the aluminum threshold frame. As the sealant spreads, it is directed by the grooves 84 generally outwardly toward the end of the threshold frame, where it forms a water tight seal between the end of the frame and the plastic jamb boot. The silicone sealant, when cured, also securely adheres the jamb boot to the end of the threshold frame such that they are virtually inseparable.

It will thus be seen that the jamb boot of FIG. 6 is easily assembled onto the end of a threshold frame in a two-step process that requires no precise alignments, no stapling, and no complex machinery. Further, it has been found that by carefully metering the amount of sealant injected through the ports 83, just enough sealant flows between the end of the threshold frame and the jamb boot to form a reliable water tight seal without the need to wipe excess sealant from the joint.

The top portion 78 of the jamb boot is formed with the general profile of a jamb 88 to be attached thereto. In this regard, the top portion 78 has a haunch 79 that overlies and rests atop the sill deck at the end of a threshold frame, mimicking the milled tenon on the bottom of a traditional wooden jamb. However, in this embodiment, the haunch 79 is slightly wider (i.e. has a slightly longer footprint) than its corresponding portion of the jamb 88, as can be seen by the footprint of the jamb on the jamb boots illustrated in phantom lines in FIG. 6. An angled or chamfered upper edge 89 of the haunch provides an aesthetically pleasing transition between the jamb boot and an attached jamb 88.

Similarly, the forward portion of the jamb boot that is configured to match the profile of the brick mold attached to the jamb is slightly wider than the brick mold and a chamfered transition 91 is provided along its forward edge. It has been found that such a configuration provides an aesthetically pleasing junction between the jamb boot and the jamb when the two are attached together and also allows for slightly out-of-spec jambs and brick mold that may otherwise make for an unsightly joint.

The top face or surface of the upper portion of the jamb boot, on which the bottom of the jamb rests, is formed to be substantially level to accept and support a square-cut jamb bottom as shown. However, the portion of the upper surface that underlies the brick mold is raised slightly above the portion that underlies the jamb itself, thus forming a step or stop 92. Small alignment nibs 93 project upwardly at strategic locations around the periphery of the upper surface as shown. The alignment nibs 93 and the stop 92 engage the bottom portion of the jamb 88 when it is brought into registration with the jamb boot, thereby providing precise alignment of the jamb with the jamb boot without the need for jigs or other alignment machinery. Caulking grooves 94 also are formed in the upper surface of the jamb boot and screw holes 96 extend vertically therethrough as discussed above for attaching a jamb to the jamb boot. Also as discussed above, an internal drain may be formed in the jamb boot that collects water at its mouth 97 from the upwardly open channel of the threshold and drains the water harmlessly to the front of the jamb boot, where it is expelled through drain port 98.

Using a threshold assembly incorporating a jamb boot as shown in FIG. 6, the assembly of an entryway by a prehanger is a simple and efficient matter and can be done on a horizontal table. First, a bead of caulk is applied with a caulking gun in the caulking grooves 94. The caulking grooves 94 guide the tip of the caulking gun to place the caulk in the proper pattern and location and help meter the proper amount of caulk. The square-cut bottom ends of the jambs of the entryway are then brought into contact with the jamb boots and there are precisely aligned with the jamb boots by the stop 92 and alignment nibs 93. The jambs are then simply attached to their boots with screws extending upwardly through the boots and into the bottoms of the jambs, the caulk being squeezed to help seal the junction between the jamb bottoms and their jamb boots. Doors, sidelight panels, and the like can then be mounted in the resulting entryway frame to complete fabrication of an entryway of the present invention.

FIG. 7 simply illustrates a bottom corner of an assembled entryway incorporating the jamb boot of FIG. 6. The jamb boot 76 is secured as described on the end of a threshold frame 100. The jamb 88 sits atop and is secured to the jamb boot 76 with the chamfered edges 91 providing a pleasing appearance and tolerance for slightly out-of-spec jambs. It should be noted that the junction 99 between the inside portion of the jamb and the jamb boot is maintained flush by the alignment nibs and stop when the jamb is aligned and attached. A flush joint at this location is desired because entryways often are provided with corner pads that span the joint and a non-flush joint could result in a gap between the jamb and the pad causing a potential water leak.

It will be recognized that the jamb boot of FIGS. 6 and 7 are not formed with a slot for accommodating the downward projection of a length of weather strip. This is an intentional feature in this embodiment. More specifically, the weather strip in this embodiment does not extend down to the sill deck but instead terminates at the top of the jamb boot. This prevents water that may collect on the sill deck from wicking up the fold in the weather strip and into a dwelling. Thus, the lack of a weather strip slot in this embodiment is a leak managing feature.

Figure 8:
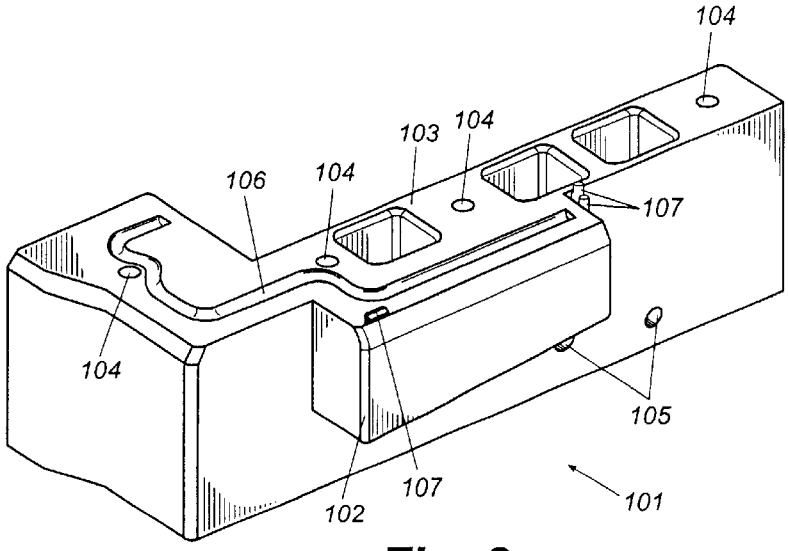
FIG. 8 is a perspective view of yet another embodiment of a jamb boot according to the invention that may be attached to the end of a threshold assembly with screws in a more traditional way.

FIG. 8 illustrates another alternate embodiment of a jamb boot 101 that incorporates principles of the invention. This embodiment is similar in some respects to the previous embodiment, but is configured to be attached to the end of a threshold frame with screws or staples in the same way that the milled bottom end of a traditional wooden jamb may be attached. In this regard, the attachment and support blocks of the previous embodiment are not present but, instead, screw holes 105 may be provided for attaching the jamb boot 101 to the end of the substrate or support block of a traditional threshold frame. Alternatively, the jamb boot 101 may be attached with staples or other appropriate fastening means. The jamb boot 101 has a profile corresponding generally to that of a jamb and brick mold and includes a haunch 102 and a level upper surface 103. Screw holes 104 extend through the jamb boot 101 for receiving screws that extend into the bottom end of a jamb to secure the jamb to the jamb boot. As with the previously discussed embodiment, alignment nibs 107 and a caulking groove 106 are provided for aligning the jamb boot precisely with a jamb prior to attachment and for sealing the junction between the bottom of the jamb and the jamb boot. With the embodiment of FIG. 8, standard threshold frames that already have underlying support blocks or substrates can be provided with jamb boots of the present invention to provide all the advantages discussed above with respect thereto. Further, the jamb boot of FIG. 8 may be pre-attached to the bottom of a jamb and the resulting assembly attached to a threshold assembly in the same way that a traditional all-wooden jamb previously has been attached.

Figure 9:
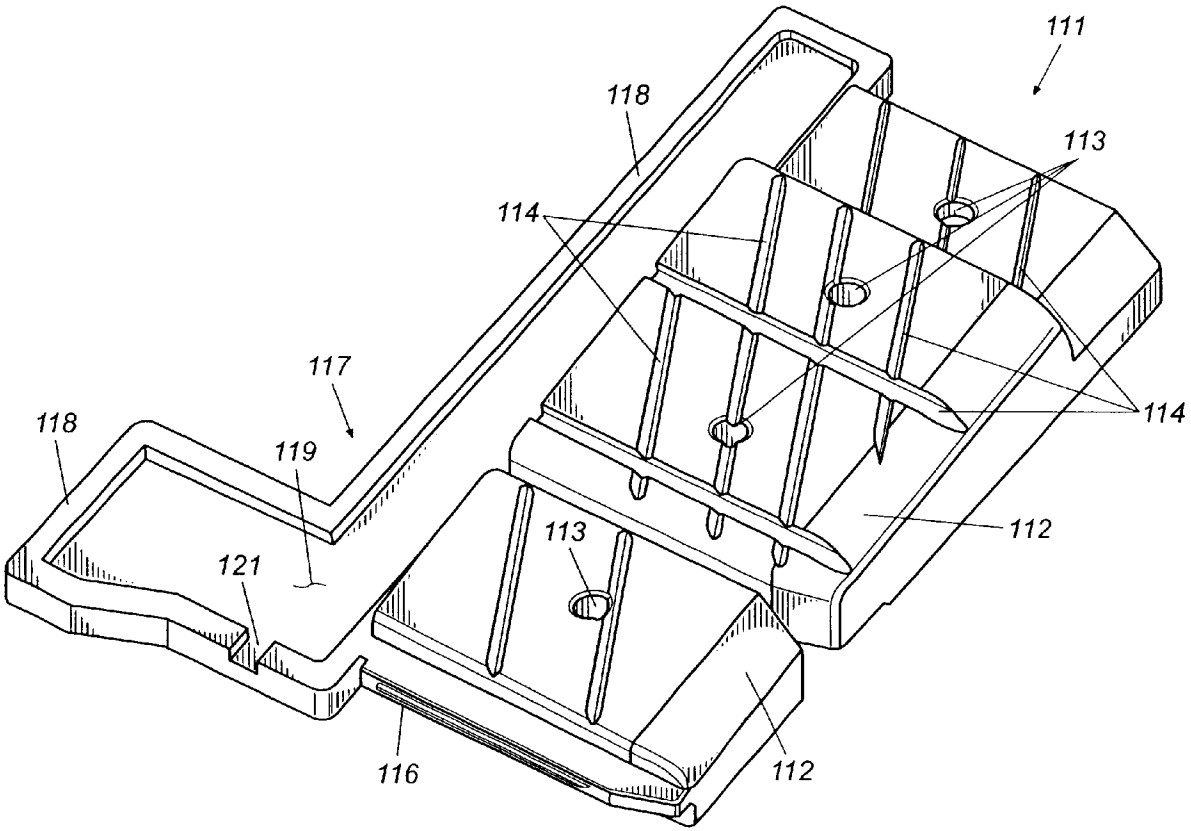
FIG. 9 is a perspective view of still another embodiment of a jamb boot according to the invention for use with a traditionally milled-bottom wooden jamb to prevent water seepage and resulting rot and deterioration.

FIG. 9 illustrates still another embodiment of a jamb boot that embodies principles of the invention. The jamb boot of this embodiment is intended for use with a threshold assembly to which a traditional milled-bottom wooden jamb is to be attached, but where it nevertheless is desired to reduce rotting due to water seepage into the bottom end of the jamb. With reference to FIG. 9, the jamb boot 111 includes attachment and support blocks 112 that are similar in configuration and function to the attachment and support blocks 81 of FIG. 6. More specifically, the attachment and support blocks 112 are formed with adhesive injection ports 113, angled adhesive flow directing slots or grooves 114, and friction lock tabs 116. With this embodiment, the jamb boot 111 is installed on the end of a threshold frame in the same way as the embodiment of FIG. 6. That is, the attachment and support blocks 112 are pressed into the extruded channels at the end of the frame where they are held temporarily by a friction fit between the channel walls and the friction lock tabs 116. A measured amount of sealant is then injected from the bottom through the sealant injection ports 113 and the sealant spreads out and is directed by the grooves 114 generally toward the end of the threshold frame. The sealant, when cured, permanently attaches the jamb boot to the threshold frame and forms a seal against water leakage.

A jamb plate 117 projects from the attachment and support blocks 112 and is profiled to match the profile of the bottom of a jamb and brick mold. The jamb plate 117 preferably is formed with a raised peripheral rim 118 that bounds and surrounds an internal reservoir 119. A weep hole 121 is formed in the peripheral rim 118 at the forward edge of the jamb plate for draining water that might collect in the reservoir away from the entryway. In practice, the jamb boot of FIG. 9 is attached to the ends of a threshold frame. Traditional milled-bottom wooden jambs are then positioned so that their bottom ends rest on the jamb plates 117 and their milled haunches overlie and rest atop the sill deck at its ends. The jamb bottoms are then attached to the ends of the threshold assembly in the traditional way with screws or staples.

When the resulting entryway is installed, the bottoms of the wooden jambs do not rest directly on the subfloor as with traditional entryways. Instead, the jamb bottoms are supported on the rot resistant jamb plates. Thus, moisture that may leak onto the subfloor does not wick into and rot the bottoms of the jambs. In addition, in the event that moisture should leak beneath the jambs from the threshold assembly, the moisture tends to collect in the reservoirs 119 where it is not in contact with the bottom ends of the jambs and can drain away harmlessly through the weep holes 121. It thus will be seen that many of the advantages of the previously discussed embodiments of the present invention can be realized with traditional milled-bottom wooden jambs by incorporating the jamb boot of FIG. 9.

The invention has been described herein in terms of preferred embodiments and methodologies. It will be understood by those of skill in the art, however, that a wide variety of additions, deletions, and modifications might be made to the illustrated embodiments consistent with and within the scope of the invention. For example, while the preferred embodiments of the jamb and mull post boots are made of injection molded plastic, they may be made from any other decay resistant material such as, for example, PVC with fillers such as rice hulls or sawdust, epoxies, wood composites, recycled plastics, or another appropriate material. Further, while most embodiments of the jamb boots of this invention have been illustrated with both jamb and brick mold portions, the brick mold portions may in fact be removed and/or provided as a separate component that can be selectively affixed as needed. The particular configurations of the components of the jamb and mull boots, including the configuration of the drain channel, caulking grooves, and the like, while preferred, are not necessarily required and other configurations may well be selected by those of skill in the art. These and other additions, deletions, and modifications of the illustrated and preferred embodiments might be made without departing from the spirit and scope of the invention as set forth in the claims.

What is claimed is:

1. An entry system comprising a threshold assembly having ends, a jamb boot attached to each of said ends of said threshold assembly, a pair of jambs each having top and bottom ends, each jamb resting at its bottom end on a respective one of said jamb boots, a head jamb spanning said top ends of said jambs to form an entryway frame, and a door mounted in said entryway frame, and wherein each of said jamb boots projects upwardly from said threshold assembly to an upper surface of said jamb boot, said jamb bottoms resting on said upper surfaces of said jamb boots with no part of said jamb bottoms resting on said threshold assembly.

2. An entryway system comprising a threshold assembly having ends, a jamb boot attached to each of said ends of said threshold assembly, a pair of jambs each having top and bottom ends, each jamb resting at its bottom end on a respective one of said jamb boots, a head jamb spanning said top ends of said jambs to form an entryway frame, and a door mounted in said entryway frame, wherein each of said jamb boots includes a jamb plate that rests on a sub-floor on which said entryway system is installed, said jamb bottoms resting on said jamb plates, and wherein said jamb plates are formed with reservoirs beneath said jamb bottoms for collecting water and a weep hole for directing collected water away from said entryway system.

3. An entryway system comprising a threshold assembly having ends, a jamb boot attached to each of said ends of said threshold assembly, a pair of jambs each having top and bottom ends, each jamb resting at its bottom end on a respective one of said jamb boots, a head jamb spanning said top ends of said jambs to form an entryway frame, and a door mounted on said entryway frame, wherein said threshold assembly is formed with a channel at each of its ends and wherein each of said jamb boots is formed with at least one attachment and support block disposed in said channel thereby attaching said jamb boot to said threshold assembly, and wherein said attachment and support block is held in said channel with an adhesive.

4. An entryway system as claimed in claim 3 and wherein said adhesive is a silicone sealant.

5. An entryway system comprising a threshold assembly having ends, a jamb boot attached to each of said ends of said threshold assembly, a pair of jambs each having top and bottom ends, each jamb resting at its bottom end on a respective one of said jamb boots, a head jamb spanning said top ends of said jambs to form an entryway frame, a door mounted in said entryway frame, a mull boot attached to said threshold assembly and a mull post having a bottom end resting on said mull boot and extending upwardly to said head jamb.

6. A threshold assembly comprising:

an elongated frame having ends;

an upwardly open channel extending between said ends;

a sill extending outwardly and sloping downwardly from said upwardly open channel to a forward edge;

a threshold cap disposed in said upwardly open channel;

a first jamb boot attached to one end of said elongated frame and having an upper surface for receiving and being attached to the bottom end of a first vertical jamb;

a second jamb boot attached to the other end of said elongated frame and having an upper surface for receiving and being attached to the bottom end of a second vertical jamb, a mull post boot attached to said elongated frame intermediate ends of said elongated frame and having an upper surface for receiving and being attached to the bottom end of a mull post.

7. A threshold assembly comprising:

an elongated frame having ends;

an upwardly open channel extending between said ends;

a sill extending outwardly and sloping downwardly from said upwardly open channel to a forward edge;

a threshold cap disposed in said upwardly open channel;

a first jamb boot attached to one end of said elongated frame and having an upper surface for receiving and being attached to the bottom end of a first vertical jamb;

a second jamb boot attached to the other end of said elongated frame and having an upper surface for receiving and being attached to the bottom end of a second vertical jamb, wherein said frame is formed with at least one channel along its bottom side, and wherein said jamb boots include attachment and support blocks that extend into said channel at the ends of said frame for attaching said jamb boots to said frame, wherein said attachment and support blocks are formed with friction lock tabs that bear against said channel for holding said jamb boots in place with a friction fit, and wherein said attachment and support blocks are formed with adhesive injection ports for injecting adhesive between said channel and said attachment and support blocks to fix said support blocks in said channel.

8. A threshold assembly comprising:

an elongated frame having ends;

an upwardly open channel extending between said ends;

a sill extending outwardly and sloping downwardly from said upwardly open channel to a forward edge;

a threshold cap disposed in said upwardly open channel;

a first jamb boot attached to one end of said elongated frame and having an upper surface for receiving and being attached to the bottom end of a first vertical jamb;

a second jamb boot attached to the other end of said elongated frame and having an upper surface for receiving and being attached to the bottom end of a second vertical jamb, and wherein said jamb boots project upwardly from said threshold assembly to said upper surfaces and wherein said upper surfaces are at least partially level for receiving and being attached to a square-cut bottom end of at least one of said first and second vertical with no part of said bottom end resting on said elongated frame jambs.

9. A threshold assembly as claimed in claim 8 and further comprising alignment nibs formed on said jamb boots for aligning the bottom ends of said jambs with said jamb boots prior to attaching said jambs to said jamb boots.

10. A threshold assembly as claimed in claim 9 and further comprising caulking grooves formed in said upper surfaces of said jamb boots.

* * * * *